US006409276B1

(12) United States Patent
Sult et al.

(10) Patent No.: US 6,409,276 B1
(45) Date of Patent: Jun. 25, 2002

(54) WATER-JET ASSISTED DRUM-TYPE MINING SYSTEM

(75) Inventors: Donald B. Sult, Charlottesville; Jeffrey J. Schwoebel, Free Union, both of VA (US)

(73) Assignee: Amvest Systems, Inc., Charlottesville, VA (US)

( * ) Notice: Subject to any disclaimer, the term of this patent is extended or adjusted under 35 U.S.C. 154(b) by 0 days.

(21) Appl. No.: 09/540,044

(22) Filed: Mar. 31, 2000

Related U.S. Application Data

(60) Provisional application No. 60/127,515, filed on Apr. 2, 1999.

(51) Int. Cl.[7] ..... E21C 25/60
(52) U.S. Cl. ..... 299/17; 299/81.1
(58) Field of Search ..... 299/16.17, 81.1, 299/81.2, 81.3

(56) References Cited

U.S. PATENT DOCUMENTS

| | | | | |
|---|---|---|---|---|
| 2,650,813 A | | 9/1953 | Rollins et al. | 262/33 |
| 2,743,095 A | * | 4/1956 | Wright | 299/17 |
| 3,554,602 A | * | 1/1971 | Chaney | 299/17 |
| 3,614,162 A | | 10/1971 | Teeter | 299/67 |
| 3,730,593 A | | 5/1973 | Karlovsky, Jr. | 299/76 |
| 3,799,615 A | | 3/1974 | Taylor et al. | 299/59 |
| 3,804,466 A | | 4/1974 | Cilles | 299/78 |
| 4,049,318 A | | 9/1977 | Fruin | 299/81 |
| 4,212,497 A | | 7/1980 | Borowski et al. | 299/53 |
| 4,285,549 A | * | 8/1981 | Zitz et al. | 299/17 |
| 4,314,730 A | | 2/1982 | Plumpton et al. | 299/75 |
| 4,451,089 A | | 5/1984 | Paurat et al. | 299/43 |
| 4,648,660 A | | 3/1987 | Mann et al. | 299/10 |
| 4,669,786 A | * | 6/1987 | Morgan | 299/79.1 |
| 4,836,613 A | | 6/1989 | Adam | 299/81 |
| 4,846,631 A | | 7/1989 | Parrott | 417/273 |
| 5,114,213 A | | 5/1992 | Kornecki et al. | 299/81 |
| 5,407,253 A | * | 4/1995 | Page et al. | 299/11 |
| 5,507,565 A | | 4/1996 | LeBegue et al. | 299/12 |
| 5,690,392 A | | 11/1997 | Clapham | 299/81.1 |

FOREIGN PATENT DOCUMENTS

| | | | |
|---|---|---|---|
| DE | 30 49 216 A1 | | 7/1982 |
| DE | 31 48 826 A1 | | 6/1983 |
| DE | 35 21 560 A1 | | 5/1986 |
| DE | 3609754 A1 | * | 9/1987 |
| GB | 2 125 850 A | | 3/1984 |

OTHER PUBLICATIONS

Partial International Search Report dated Jul. 20, 2000 for PCT/US00/08572.

Hartman, H. (Senior Ed.) "SME Mining Engineering Handbook", 1992, PP 1924–1928.*

Database WPI, Section PQ, Week 199922, Derwent Publications Ltd., London, GB; Class Q49, AN 1999–264201 XP002153117 & 9 806 639 A (Kennametal Inc.) Apr. 28, 1999 (Apr. 28, 1999) abstract.

Complete International Search Report dated Nov. 28, 2000 for PCT/US00/08572.

* cited by examiner

*Primary Examiner*—David Bagnell
*Assistant Examiner*—John Kreck
(74) *Attorney, Agent, or Firm*—Jenkens & Gilchrist, P.C.

(57) ABSTRACT

A drum-type miner having a plurality of water jet nozzles which cut independently of the mechanical bits is disclosed. The drum-type miner may configured in either a hard-head or a ripper-chain design. The unique combination of mechanical and hydraulic cutting results in higher rates of penetration and improved productivity. Moreover, because the mining face is pre-scored by the water jets, the amount of wear on both the mechanical bits and the motors may be significantly reduced.

24 Claims, 6 Drawing Sheets

WATER-JET ASSISTED DRUM-TYPE MINING SYSTEM

RELATED APPLICATIONS

This application claims priority to commonly-owned and co-pending U.S. Provisional Patent Application 60/127,515 filed on Apr. 2, 1999, and which is incorporated in its entirety herein by specific reference thereto.

BACKGROUND OF THE INVENTION

1. Field of the Invention

The present invention generally pertains to mineral mining processes and, more particularly, but not by way of limitation, to a mining system particularly adapted for the recovery of coal from coal seams.

2. History of the Related Art

The recovery of coal, ore, or other material from mineral bearing strata or seams has been the subject of technological development for centuries. Among the more conventional mining techniques, drum-type mining systems have found industry acceptance. Drum-type mining machines typically utilize a cutting head having a rotating cylinder or drum with a plurality of mechanical bits on an exterior surface for cutting into the mineral bearing material. The dislodged material is permitted to fall to the floor of the mining area, gathered up, and transported to the mining surface via conveyors or other transportation means.

Although drum-type mining machines have proven effective, conventional drum-type cutting systems generally rely solely on a mechanical cutting action which subjects motors and bits to considerable wear and produces significant amounts of dust. Also, to increase the productivity of conventional mechanical cutting machines will normally require the installation of larger and heavier cutting motors on the miner to produce the additional power needed.

Thus, there is a need for a reliable mining system which addresses the limitations of the above-described conventional mining systems and which achieves higher rates of penetration and improved productivity.

SUMMARY OF THE INVENTION

The present invention overcomes the foregoing and other problems with a water jet assisted, drum-type mining system which positions a plurality of high pressure water jets to cut the mining face independently of mechanical bits. This unique combination of mechanical and hydraulic cutting results in higher rates of penetration and improved productivity. The high pressure water used in cutting may be pumped via a hose line or other conduit from a remote location. Alternatively, a high pressure water pump may be located on the chassis of the miner. Of course, this means that the cutting motors on the drum-type miner itself can be much smaller than the motors used to generate equivalent production by conventional means. Moreover, because the mining face is pre-scored by the water jets, the amount of wear on both the mechanical bits and the motors may be significantly reduced.

BRIEF DESCRIPTION OF THE DRAWINGS

For a more complete understanding of the present invention, and for further objects and advantages thereof, reference is made to the following Detailed Description taken in conjunction with the accompanying drawings in which.

DETAILED DESCRIPTION

The preferred embodiment of the present invention and its advantages are best understood by referring to FIGS. 1–8 of the drawings, like numerals being used for like and corresponding parts in each of the various drawings.

Figure 1:
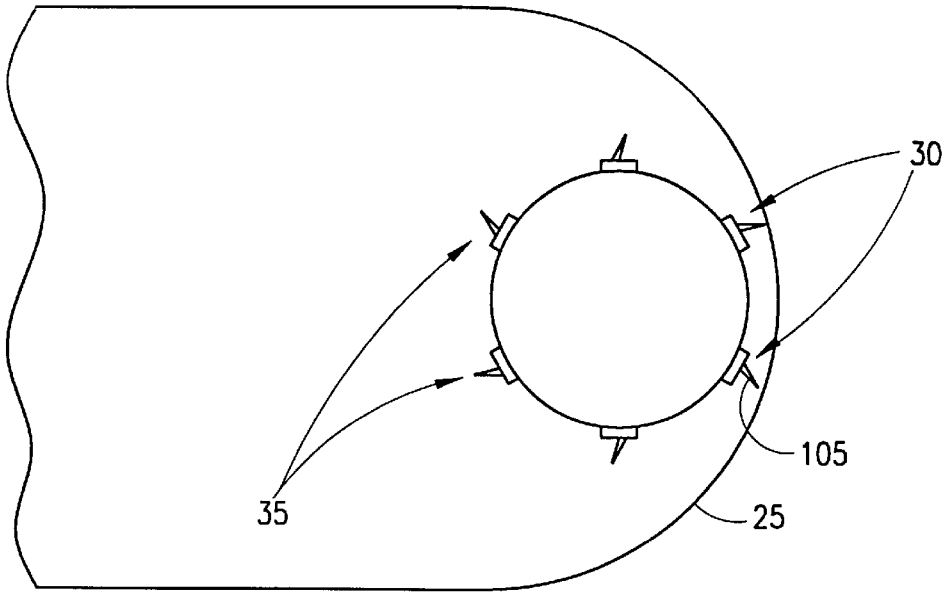
FIG. 1 is a side elevational view of a drum-type cutting head contacting a mineral seam.

The mechanical cutting capabilities of drum-type continuous miners, used for mining coal and other minerals, can be supplemented by the inclusion of high-pressure water jets. Unlike borer-type miners where mechanical bits continuously contact the cutting face, the mechanical bits on a drum miner cut coal or contact the excavation point less than 50% of the circumference of the drum. As best seen in FIG. 1, less than half of the mechanical bits 105 on the drum-type cutting head 110 typically contact the cutting surface 25 at one time. For example, the bits denoted by reference number 30 are in contact with and cutting the mining face 25 while the other bits 35 will not contact the mineral seam until the drum is rotated almost 180°. This also complicates the addition of water jets to the rotating drum 110 itself, and substantially reduces their effectiveness because, if mounted this way, at least half of the nozzles would be directed away from the mining face 25 at any one time.

Figure 2:
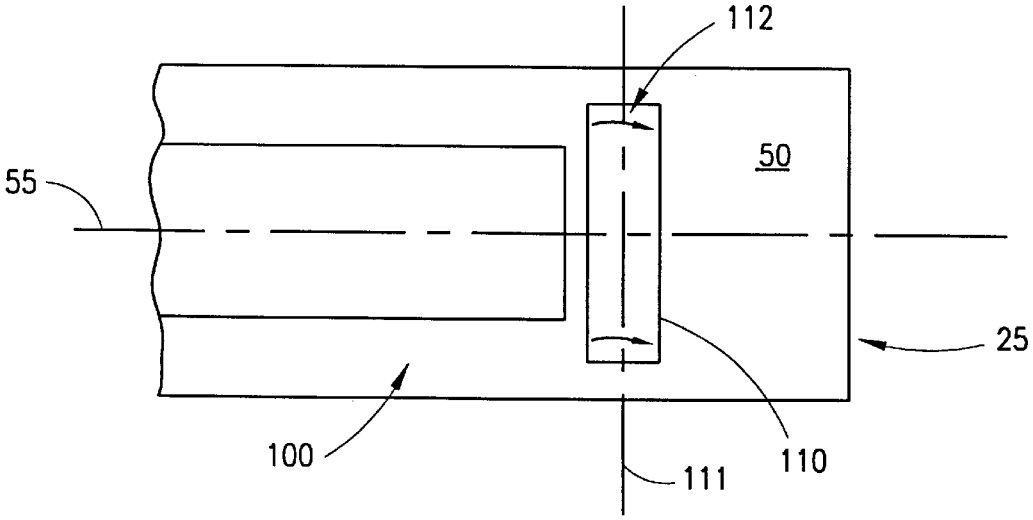
FIG. 2 is a simplified, top plan view of a drum-type mining system.

As best seen in FIG. 2, a simplified drum-type continuous miner 100 has a horizontal cylinder or drum 110 with its axis of rotation 111 perpendicular to the center line 55 of the opening or entry being developed 50. As the miner 100 is advanced toward the mining face 25, the drum is turned in a top-forward direction of rotation 112 to achieve a cutting action with the mechanical bits, not shown. Also, the drum 110 is generally moved up and down in a vertical plane, not shown, to increase the height of the opening 50 and overall production.

Figure 3A:
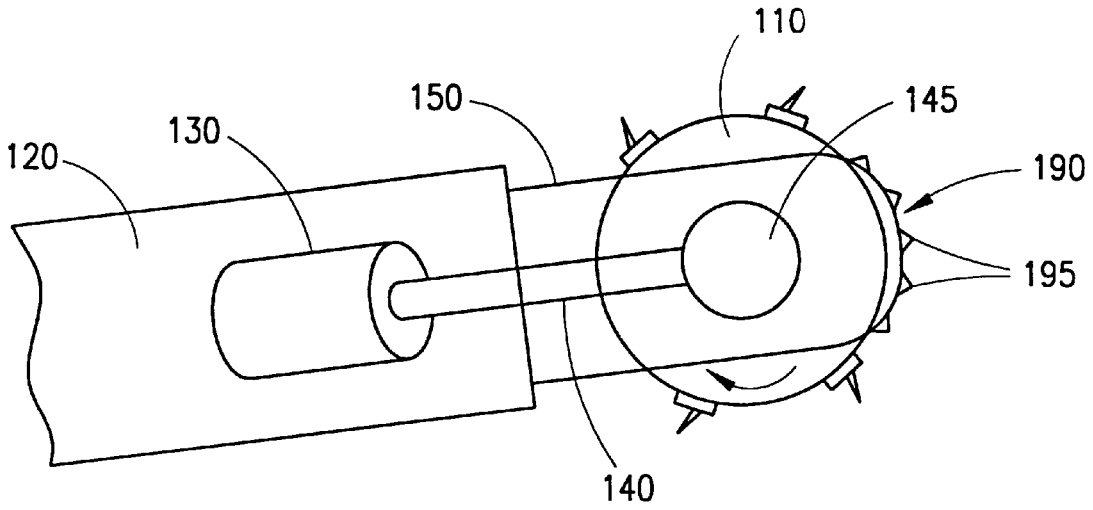
FIG. 3*a* is a cutaway, side elevational view of a hard-head cutting head for drum-type mining systems.
Figure 3B:
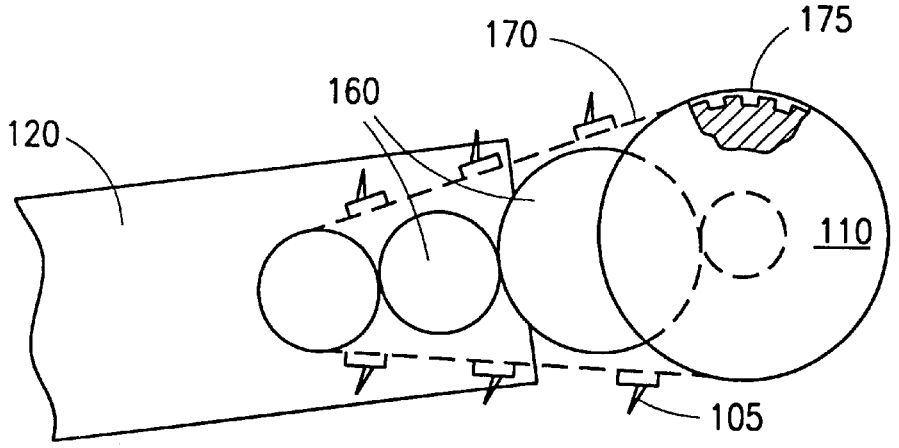
FIG. 3*b* is a cutaway, side elevational view of a ripper-chain cutting head for drum-type mining systems.

With reference now to FIGS. 3*a* and 3*b* together, the cylinder 110 is rotatably mounted to an arm or a boom 120. The electric motors 130 to rotate the drum 110 may be mounted in the body of the miner, not shown, or the boom 120, with the energy being transferred from the motors 130 to the drum 110 using either: (1) rotating drive shafts 140 housed within fixed supports 150, as shown in FIG. 3A, or (2) gears 160 located behind and beneath a cutter or ripper chain 170, seen in FIG. 3B, which wraps around the drum 110, a central portion of which has gear-like teeth 175 for engaging the underside of the chain 170, and an idler located on the support boom 120. Either of these methods uses the rotating mechanical energy of an electric motor 130 to cause the drum 110 to rotate, top forward at a speed of approximately 60 revolutions per minute.

Figure 4:
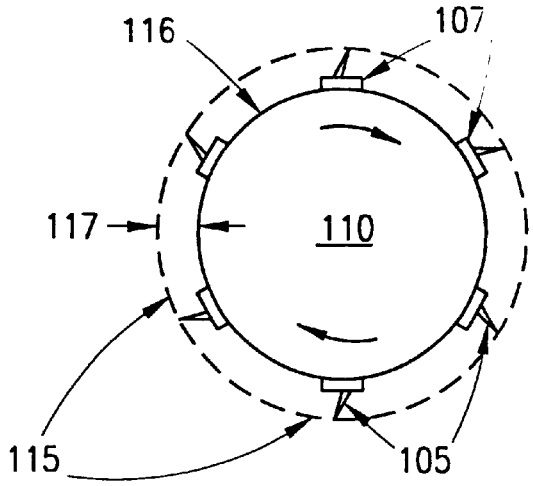
FIG. 4 is a side elevational view of a cutting drum with mechanical bits mounted on an exterior surface and showing an effective cutting diameter.

As best seen in FIG. 4, the effective cutting diameter 115 as defined by the cutting bits 105 is greater than the diameter 116 of the smooth exterior surface of the drum 110. This provides an off-set or distance 117 within which water jet nozzles and high pressure conduits may be mounted as in FIGS. 6A and 6B. The distance 117 may be calculated by subtracting the drum radius from the effective cutting radius. This distance 117 will typically range from about 3 to about 8 inches, but it is understood that this distance 117 is dependent only on the size of the drum 110 and the length of the bits 105 and bit blocks 107 selected and is not limited only to this particular range.

Figure 5:
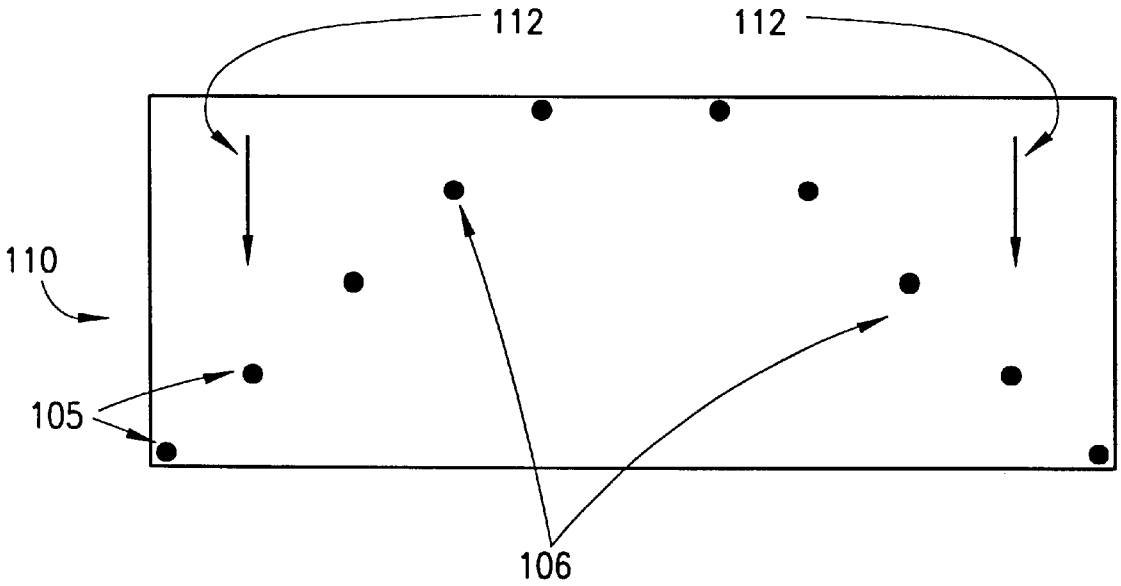
FIG. 5 is a front elevational view of a cutting drum showing a typical scrolling pattern to the bits.

As illustrated in FIG. 5, mechanical bits 105 are typically attached to the smooth exterior surface of the drum 110 in positions that create various patterns as it rotates. This is referred to as the scroll 106 of the bits 105. The spacing of the track, made by the mechanical bits 105 on the cutting surface 25, varies, depending on the longitudinal spacing of the mechanical bits 105. Typically, the track spacing or bit lace spacing will be from about 1.5 to about 3 inches, or more. These mechanical bits 105 are removable. They are inserted in bit lugs or bit blocks 107, which are in turn welded solidly to the exterior surface of the drum 110. The mechanical bits 105 can be routinely removed from this bit lug 107 and replaced as they wear.

The plumbing necessary to provide high-pressure water at sufficient flows to water jets can take advantage of the bit spacing or lacing, and the distance 117 between the smooth exterior surface of the drum 110 and the actual cutting diameter of the bits 105. Water jets can be preferably mounted in two different ways.

Figure 6A:
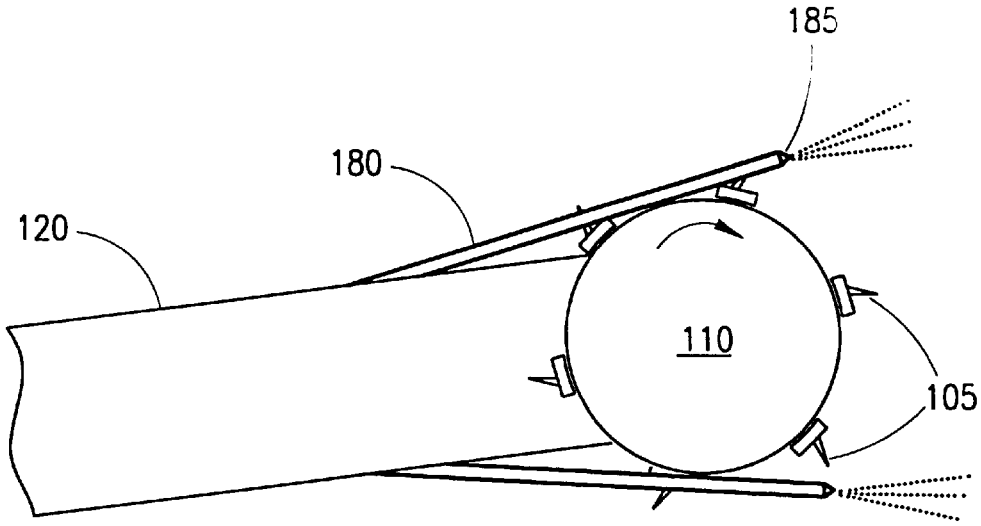
FIG. 6*a* is a side elevational view of a water jet assisted cutting head of the present invention showing a high pressure fluid conduit mounted tangentially above and below the drum.

As shown in FIG. 6A, a first embodiment would involve the addition of a high pressure water hose, not shown, and metal piping 180, which is run from the miner body or the boom 120 and mounted tangent to the upper and lower surfaces of the drum 110. This piping 180, positioned within the effective cutting diameter 115 of the cutting head 110, can actually extend beyond the center line of the cylinder 110, so that the water jet nozzles 185, are only slightly back from the mechanical bits 105 in contact with the mineral seam, not shown.

Figure 6B:
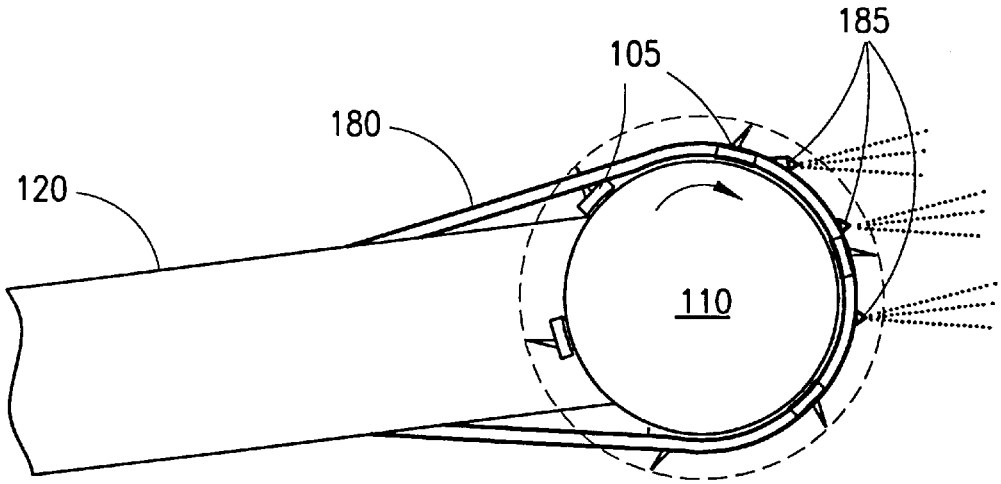
FIG. 6*b* is a side elevational view of a water jet assisted cutting head of the present invention showing a high pressure fluid conduit shaped to fit between the exterior surface of the drum and the effective cutting diameter as defined by the mechanical bits.

As illustrated in FIG. 6B, a second embodiment would involve the addition of a high pressure water hose, not shown, and metal piping 180, which is run from the miner body or the boom 120 and may be curved or shaped to fit about the circumference of and just beyond the smooth exterior surface of the drum 110. The piping or conduits 180 are positioned within the effective cutting diameter 115 of the cutting head 110, and can be tapped and fitted with nozzles 185 which are located between the surface of the drum 110 and the cutting face 25 of the material being mined. Thus, the distance between the coal face 25 and the nozzles 185 is effectively minimized.

Either of these two exemplary embodiments would provide rigidly mounted high-pressure conduits 180 having water jet nozzles 185 at a very close distance to the solid coal being cut. The jet nozzles 185 provide high-pressure water which assists mining by cutting and creating a vertical slot or groove in the coal face from roof to floor as the drum 110 is moved up and down in a conventional cutting motion. These vertical grooves effectively pre-score the coal face and make it far easier for the mechanical bits 105 to then fracture the coal.

Figure 7:
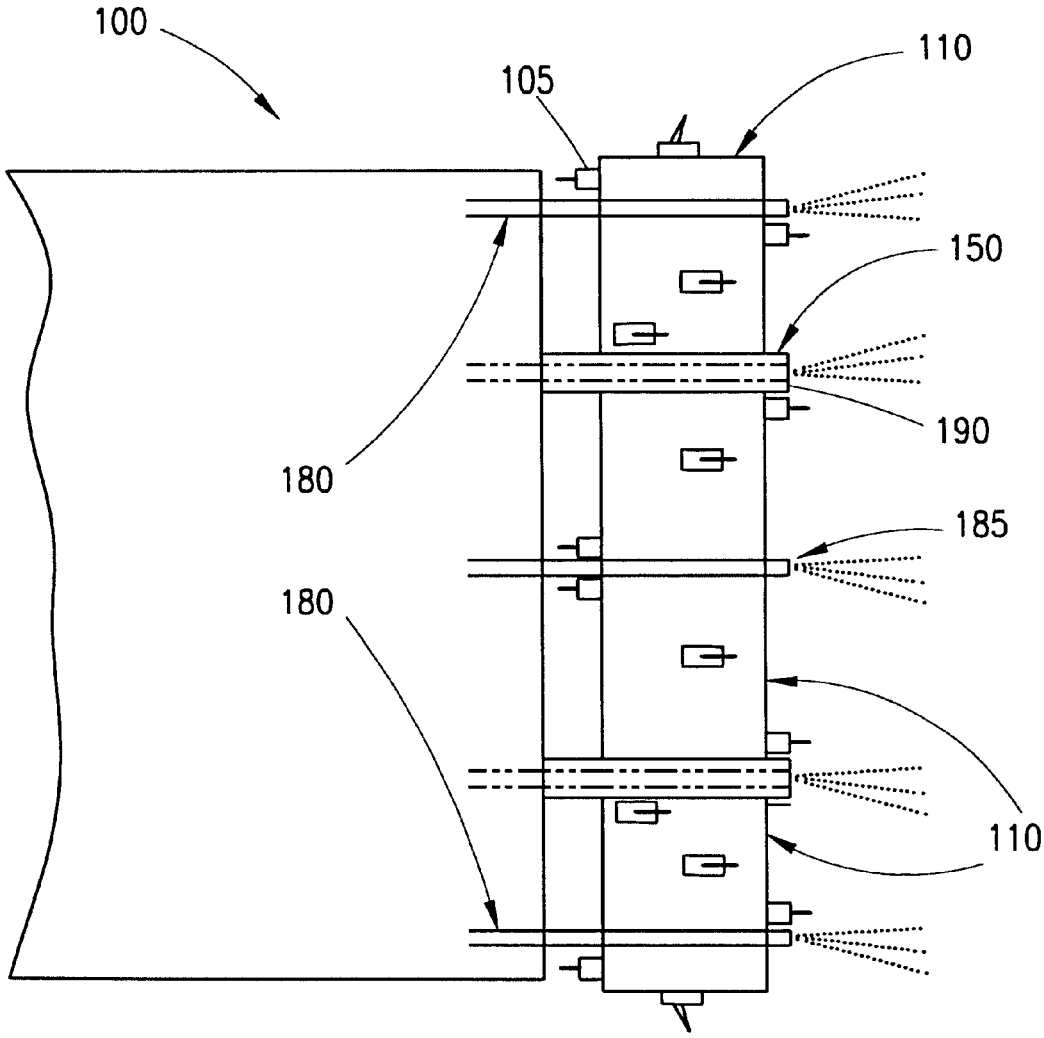
FIG. 7 is a top plan view of a hard-head embodiment of the water-jet assisted cutting head of the present invention.

As shown in FIG. 7, an alternative method of mounting water jets 185 would involve running high-pressure water lines 180 at least partially within the existing support struts 150 of a hard-head miner, introduced in FIG. 3A. Various techniques are used to rotate the drum 110. The support struts 150 are rigid, non-rotating members that may or may not contain drive shafts for rotating the cylinder 110. The plumbing 180 can provide high-pressure water and sufficient flow to several water jets 185 mounted on the front, or core breaker edge 190 of these support struts 150. These support struts 150 are non-rotating, while the actual segmented cylinder, or drum 110, rotates on either side of the support strut 150. Since these support struts 150 must be sufficiently wide to contain mechanical parts like a drive shaft, there is usually a zone of solid, uncut coal, referred to as a core, which forms between the two rotating drums 110. The front edge 190 of the support strut 150 typically contains bits or sharp points 195, see FIG. 3A, designed to break or cut the core, which remains between the two rotating cylinders. The high-pressure water jets 185 can be mounted in several positions on this core breaker 190. This would also place the water jets 185 very close to the surface being cut mechanically by the bits 105. In this and other mounting applications, either fixed or swivel mounted water jets can be used.

Figure 8:
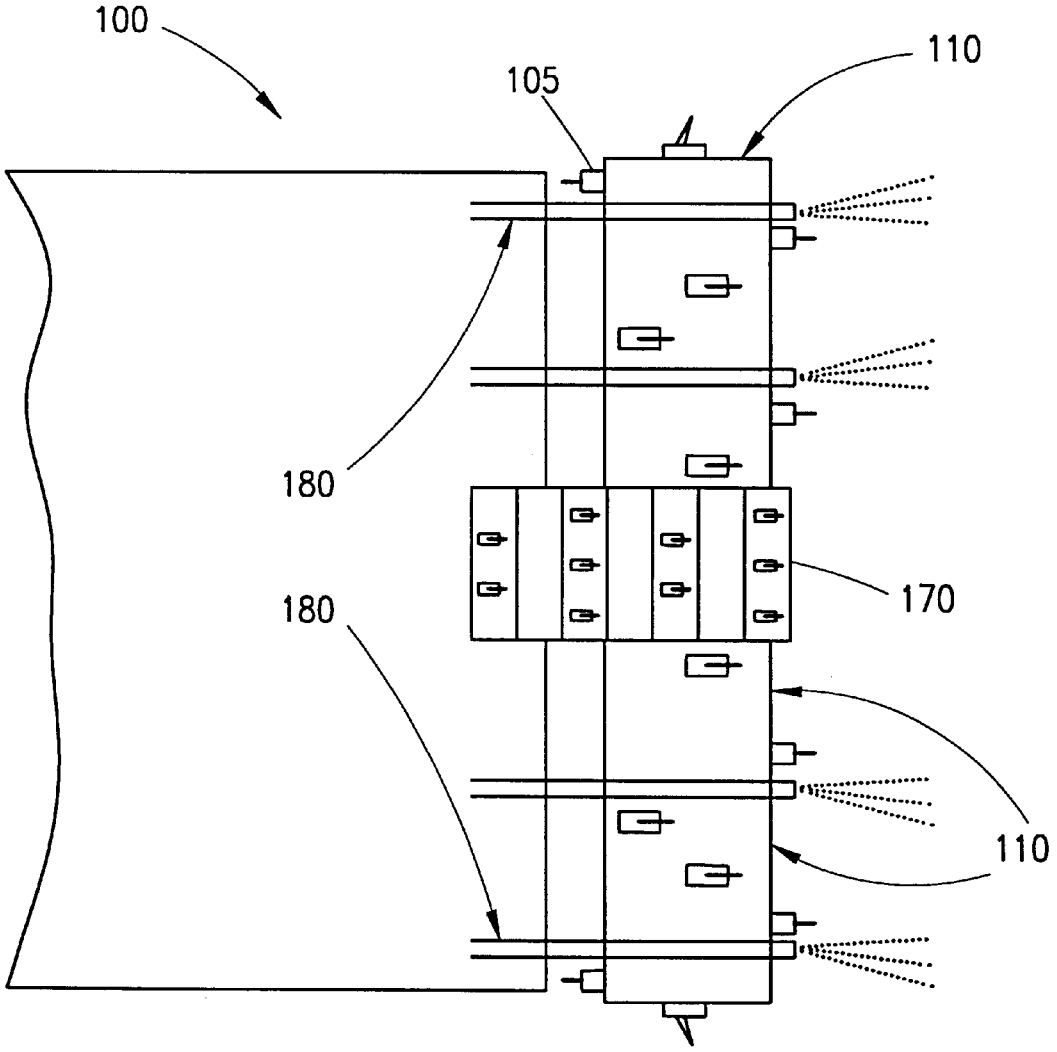
FIG. 8 is a top plan view of a ripper-chain embodiment of the water jet assisted cutting head of the present invention.

Turning now to FIG. 8, in conjunction with FIG. 3B, a ripper-chain embodiment miner of the present invention is illustrated. The drum 110 is segmented or formed of three sections which are linked together by a spline, axle or other means to turn as a single unit about a common axis of 15 rotation. The central section has gear-like teeth 175, shown in FIG. 3B, which engage the underside of a ripper chain 170. The chain 170 is looped around the drum 110, and drive gears 160. As the drive gears 160 turn, the chain 170 and the drum 110 are rotated top-forward to mine coal.

As shown in FIG. 8, the chain 170 and the outer sections of the drum 110 have mechanical bits on their exterior surfaces. As shown in FIGS. 6A and 6B, rigid conduits 180 which are tapped to supply water nozzles 185 may be located above or below the cutting portions of the drum 110 or may be curved to fit completely around the drum 110. Although the depicted embodiment has four conduits or tubes 180 around the drum 110, it is understood that these rigid tubes 180 may be provided in any number which does not hinder the cutting drum 110. If necessary, mechanical bits 105 may even be removed from the drum 100 to provide the lateral spacing required for mounting the high pressure conduits or tubes 180.

The application of high-pressure water jets 185 to the drum-type continuous miner 100 allows additional hydraulic cutting power to be provided for the excavation of coal or other materials, beyond the power provided by the mechanical cutting head motors. This additional power is provided by high-pressure water pumps, not shown, which are powered by additional motors which may be located remotely from the continuous miner 100. Of course, if small enough, these high-pressure pumps, not shown, could also be located on the continuous miner itself.

The water jets 185 assist in the liberation of the coal from the working face. The high-pressure streams of water, which are produced by the water jets 185, actually penetrate and cut into the coal surface independent of and beyond the reach of the mechanical bits 105. These slots, or grooves, cut by the high-pressure water jets 185 reduce the amount of energy required for mechanical excavation by pre-fracturing the coal and providing additional free faces for the coal to break as it is impacted by the mechanical bits 105.

The high-pressure water jets 185 and the water provided to the working area also have the significant benefit of greatly reducing the amount of coal dust liberated during the mining process. The amount and pressure of water provided to each of the water nozzles 185 may further be varied independently, depending on the specific application.

By way of example only, Table 1 is provided to better illustrate how the use water jet assisted cutting on a drum-type miner may result in significant improvements in both penetration rate and production. For comparison purposes, a conventional drum-type miner in a ripper-chain configuration was first tested using mechanical cutting alone. The miner was then fitted with a water jet system according to the present invention. The water jets were supplied at about 6,000 psi and about 150–170 gallons per minute. Data from repeated trials were then averaged to produce Table 1. It is notable that the production with water jet assistance was nearly double that of the conventional mechanical bit drum-type miner.

TABLE 1

| Technique | Penetration (ft/min) | Production (tons/hour) | Cutting Motor (amps) |
|---|---|---|---|
| Mechanical Bits Only | 1.00 | 227 | 125–130 |
| Mechanical + Water Jets | 1.83 | 415 | 100 |

Repeated tests were also made to determine the best configuration and orientation of water jets 185. It was found that the water jets 185 on a single metal conduit 180 should focus cutting to produce a vertical groove or slot rather than random erosion of the entire face.

It is thus believed that the operation and construction of the present invention will be apparent from the foregoing description of a preferred embodiment. While the device shown is described as being preferred, it will be obvious to a person of ordinary skill in the art that various changes and modifications may be made therein without departing from the spirit and scope of the invention, as defined in the following claims. Therefore, the spirit and scope of the appended claims should not be limited to the description of the preferred embodiments contained herein.

What is claimed is:

1. A water jet assisted drum-type miner for mining coal or other mineral deposits comprising:

a transversely mounted drum having a plurality of mechanical cutting bits mounted on an exterior surface of said drum;

at least one motor providing mechanical power to rotate said drum to cut said mineral deposits;

at least one conduit for supplying a high pressure fluid to a plurality of nozzles; and said plurality of nozzles each directing a high pressure jet of fluid to cut said deposits independently of said mechanical cutting bits, wherein said at least one conduit is an externally mounted tube located above or below said drum.

2. The miner of claim 1, wherein said at least one conduit is a rigid tube and is mounted tangentially to said drum.

3. The miner of claim 2, wherein said tube is shaped to fit between the exterior surface of said drum and an effective cutting diameter as defined by said mechanical cutting bits, and positions said nozzles between said exterior surface of said drum and said mineral deposits which are being cut.

4. The miner of claim 1, wherein said nozzles are positioned between the exterior surface of said drum and an effective cutting diameter as defined by said mechanical cutting bits.

5. The miner of claim 1, wherein said nozzles are aligned to cut a vertical slot or groove.

6. A water jet assisted drum-type miner for mining coal or other mineral deposits comprising:

a transversely mounted segmented drum having a plurality of mechanical cutting bits mounted on an exterior surface of said segmented drum;

at least two supports for rotatably mounting said segmented drum;

at least one electrical motor providing mechanical power to rotate said segmented drum to cut said mineral deposits;

at least one conduit located above or below said drum for supplying a high pressure fluid to a plurality of nozzles; and said plurality of nozzles each directing a high pressure jet of fluid to cut said deposits independently of said mechanical cutting bits.

7. The miner of claim 6, further comprising at least one core breaker having a plurality of mechanical bits fitted to a distal end of said supports disposed between said segments of said segmented drum.

8. The miner of claim 7, wherein said core breaker further comprises a plurality of breaker nozzles each directing a high pressure jet of fluid to cut said deposits independently of said mechanical cutting bits.

9. A water jet assisted drum-type miner for mining coal or other mineral deposits comprising:

a transversely mounted segmented drum having a center portion with a plurality of gear-like teeth on an exterior surface and two cutting portions each having a plurality of mechanical cutting bits on an exterior surface;

a drive gear;

a ripper chain having a plurality of mechanical cutting bits mounted on an exterior surface, said ripper chain fitted about said drive gear and said center portion of said segmented drum;

at least one electrical motor providing mechanical power to rotate said drive gear, said ripper chain, and said segmented drum in a top-forward manner to cut said mineral deposits;

at least one conduit externally mounted and located above or below said drum for supplying a high pressure fluid to a plurality of nozzles; and said plurality of nozzles each directing a high pressure jet of fluid to cut said deposits independently of said mechanical cutting bits.

10. The miner of claim 9, wherein said at least one conduit is a rigid tube and is mounted tangentially to said segmented drum.

11. The miner of claim 10, wherein said tube is shaped to fit between the exterior surface of said cutting portions of said segmented drum and an effective cutting diameter as defined by said mechanical cutting bits, and positions said nozzles between said exterior surface of said segmented drum and said mineral deposits which are being cut.

12. The miner of claim 9, wherein said nozzles are positioned between the exterior surface of said segmented drum and an effective cutting diameter as defined by said mechanical cutting bits.

13. The miner of claim 9, wherein said nozzles are aligned to cut a vertical slot or groove.

14. A water jet assisted drum-type miner for mining coal or other mineral deposits comprising:

a transversely mounted drum having a plurality of mechanical cutting bits mounted on an exterior surface of said drum;

at least one motor providing mechanical power to rotate said drum to cut said mineral deposits;

at least one conduit for supplying a high pressure fluid to a plurality of nozzles; and said plurality of nozzles each directing a high pressure jet of fluid to cut said deposits independently of said mechanical cutting bits, wherein said at least one conduit is an externally mounted tube located above or below said drum;

wherein said at least one conduit is a rigid tube and is mounted tangentially to said drum; and wherein said tube is shaped to fit between the exterior surface of said drum and an effective cutting diameter as defined by said mechanical cutting bits, and positions said nozzles between said exterior surface of said drum and said mineral deposits which are being cut.

15. A water jet assisted drum-type miner for mining coal or other mineral deposits comprising:

a transversely mounted drum having a plurality of mechanical cutting bits mounted on an exterior surface of said drum;

at least one motor providing mechanical power to rotate said drum to cut said mineral deposits;

at least one conduit for supplying a high pressure fluid to a plurality of nozzles; and said plurality of nozzles each directing a high pressure jet of fluid to cut said deposits independently of said mechanical cutting bits, wherein said at least one conduit is an externally mounted tube located above or below said drum; and wherein said nozzles are positioned between the exterior surface of said drum and an effective cutting diameter as defined by said mechanical cutting bits.

16. A water jet assisted drum-type miner for mining coal or other mineral deposits comprising:

a transversely mounted drum having a plurality of mechanical cutting bits mounted on an exterior surface of said drum;

at least one motor providing mechanical power to rotate said drum to cut said mineral deposits;

at least one conduit for supplying a high pressure fluid to a plurality of nozzles; and said plurality of nozzles each directing a high pressure jet of fluid to cut said deposits independently of said mechanical cutting bits, wherein said at least one conduit is an externally mounted tube located above or below said drum; and wherein said nozzles are aligned to cut a vertical slot or groove.

17. A water jet assisted drum-type miner for mining coal or other mineral deposits comprising:

a transversely mounted drum having a plurality of mechanical cutting bits mounted on an exterior surface of said drum;

at least one motor providing mechanical power to rotate said drum to cut said mineral deposits;

at least one conduit for supplying a high pressure fluid to a plurality of nozzles; and said plurality of nozzles each directing a high pressure jet of fluid to cut said deposits independently of said mechanical cutting bits, wherein said at least one conduit is an externally mounted tube located above or below said drum; and wherein said nozzles are swivel mounted.

18. A water jet assisted drum-type miner for mining coal or other mineral deposits comprising:

a transversely mounted segmented drum having a plurality of mechanical cutting bits mounted on an exterior surface of said segmented drum;

at least two supports for rotatably mounting said segmented drum;

at least one electrical motor providing mechanical power to rotate said segmented drum to cut said mineral deposits;

at least one conduit located above or below said drum for supplying a high pressure fluid to a plurality of nozzles; and said plurality of nozzles each directing a high pressure jet of fluid to cut said deposits independently of said mechanical cutting bits;

further comprising at least one core breaker having a plurality of mechanical bits fitted to a distal end of said supports disposed between said segments of said segmented drum; and wherein said core breaker further comprises a plurality of breaker nozzles each directing a high pressure jet of fluid to cut said deposits independently of said mechanical cutting bits.

19. A water jet assisted drum-type miner for mining coal or other mineral deposits comprising:

a transversely mounted segmented drum having a plurality of mechanical cutting bits mounted on an exterior surface of said segmented drum;

at least two supports for rotatably mounting said segmented drum;

at least one electrical motor providing mechanical power to rotate said segmented drum to cut said mineral deposits;

at least one conduit located above or below said drum for supplying a high pressure fluid to a plurality of nozzles;

said plurality of nozzles each directing a high pressure jet of fluid to cut said deposits independently of said mechanical cutting bits; and wherein said nozzles are swivel mounted.

20. A water jet assisted drum-type miner for mining coal or other mineral deposits comprising:

a transversely mounted segmented drum having a center portion with a plurality of gear-like teeth on an exterior surface and two cutting portions each having a plurality of mechanical cutting bits on an exterior surface;

a drive gear;

a ripper chain having a plurality of mechanical cutting bits mounted on an exterior surface, said ripper chain fitted about said drive gear and said center portion of said segmented drum;

at least one electrical motor providing mechanical power to rotate said drive gear, said ripper chain, and said segmented drum in a top-forward manner to cut said mineral deposits;

at least one conduit externally mounted and located above or below said drum for supplying a high pressure fluid to a plurality of nozzles;

said plurality of nozzles each directing a high pressure jet of fluid to cut said deposits independently of said mechanical cutting bits;

wherein said at least one conduit is a rigid tube and is mounted tangentially to said segmented drum; and wherein said tube is shaped to fit between the exterior surface of said cutting portions of said segmented drum and an effective cutting diameter as defined by said mechanical cutting bits, and positions said nozzles between said exterior surface of said segmented drum and said mineral deposits which are being cut.

21. A water jet assisted drum-type miner for mining coal or other mineral deposits comprising:

a transversely mounted segmented drum having a center portion with a plurality of gear-like teeth on an exterior surface and two cutting portions each having a plurality of mechanical cutting bits on an exterior surface;

a drive gear;

a ripper chain having a plurality of mechanical cutting bits mounted on an exterior surface, said ripper chain fitted about said drive gear and said center portion of said segmented drum;

at least one electrical motor providing mechanical power to rotate said drive gear, said ripper chain, and said segmented drum in a top-forward manner to cut said mineral deposits;

at least one conduit externally mounted and located above or below said drum for supplying a high pressure fluid to a plurality of nozzles;

said plurality of nozzles each directing a high pressure jet of fluid to cut said deposits independently of said mechanical cutting bits; and wherein said nozzles are positioned between the exterior surface of said segmented drum and an effective cutting diameter as defined by said mechanical cutting bits.

22. A water jet assisted drum-type miner for mining coal or other mineral deposits comprising:

a transversely mounted segmented drum having a center portion with a plurality of gear-like teeth on an exterior surface and two cutting portions each having a plurality of mechanical cutting bits on an exterior surface;

a drive gear;

a ripper chain having a plurality of mechanical cutting bits mounted on an exterior surface, said ripper chain fitted about said drive gear and said center portion of said segmented drum;

at least one electrical motor providing mechanical power to rotate said drive gear, said ripper chain, and said segmented drum in a top-forward manner to cut said mineral deposits;

at least one conduit externally mounted and located above or below said drum for supplying a high pressure fluid to a plurality of nozzles; and said plurality of nozzles each directing a high pressure jet of fluid to cut said deposits independently of said mechanical cutting bits; and wherein said nozzles are aligned to cut a vertical slot or groove.

23. A water jet assisted drum-type miner for mining coal or other mineral deposits comprising:

a transversely mounted segmented drum having a center portion with a plurality of gear-like teeth on an exterior surface and two cutting portions each having a plurality of mechanical cutting bits on an exterior surface;

a drive gear;

a ripper chain having a plurality of mechanical cutting bits mounted on an exterior surface, said ripper chain fitted about said drive gear and said center portion of said segmented drum;

at least one electrical motor providing mechanical power to rotate said drive gear, said ripper chain, and said segmented drum in a top-forward manner to cut said mineral deposits;

at least one conduit externally mounted and located above or below said drum for supplying a high pressure fluid to a plurality of nozzles;

said plurality of nozzles each directing a high pressure jet of fluid to cut said deposits independently of said mechanical cutting bits; and wherein said nozzles are swivel mounted.

24. A water jet assisted drum-type mining for mining coal or other mineral deposits comprising:

a transversely mounted segmented drum having a center portion with a plurality of gear-like teeth on an exterior surface and two cutting portions each having a plurality of mechanical cutting bits on an exterior surface;

a drive gear;

a ripper chain having a plurality of mechanical cutting bits mounted on an exterior surface, said ripper chain fitted about said drive gear and said center portion of said segmented drum;

at least one electrical motor providing mechanical power to rotate said drive gear, said ripper chain, and said segmented drum in a top-forward manner to cut said mineral deposits;

at least one conduit externally mounted and located above or below said drum for supplying a high pressure fluid to a plurality of nozzles;

said plurality of nozzles each directing a high pressure jet of fluid to cut said deposits independently of said mechanical cutting bits; and wherein said nozzles are swivel mounted.

* * * * *

UNITED STATES PATENT AND TRADEMARK OFFICE

CERTIFICATE OF CORRECTION

PATENT NO. : 6,409,276 B1
DATED : June 25, 2002
INVENTOR(S) : Donald B. Sult et al.

It is certified that error appears in the above-identified patent and that said Letters Patent is hereby corrected as shown below:

Column 4,
Line 36, replace “common axis of 15” with -- common axis of --

Column 10,
Line 34, replace “mining for mining coal” with -- miner for mining coal --

Signed and Sealed this

Twenty-ninth Day of October, 2002

*Attest:*

*Attesting Officer*

JAMES E. ROGAN
*Director of the United States Patent and Trademark Office*